United States Patent [19]

Benoit

[11] Patent Number: 4,674,746

[45] Date of Patent: Jun. 23, 1987

[54] GOLF CLUB

[76] Inventor: William R. Benoit, 336 Pleasant St., Laconia, N.H. 03246

[21] Appl. No.: 593,974

[22] Filed: Mar. 27, 1984

[51] Int. Cl.[4] ..... A63B 53/00

[52] U.S. Cl. ..... 273/81 A; 273/67 R; 273/73 R; 273/80 A; 273/169; 30/308.1; 81/20

[58] Field of Search ..... 273/81 A, 80 A, 80 B, 273/169, 67 R, 73 R; 145/29 R, 61 R

[56] References Cited

U.S. PATENT DOCUMENTS

| | | | |
|---|---|---|---|
| 1,026,990 | 5/1912 | Matson | 273/81 A X |
| 1,210,182 | 12/1916 | Lynch | 273/81 A |
| 1,304,647 | 5/1919 | Basta | 273/81 A X |
| 1,585,190 | 5/1926 | Girdwood | 273/80 A |
| 1,658,447 | 2/1928 | Lantz | 273/81 A |
| 1,676,270 | 7/1928 | Mattison | 273/80 A X |
| 1,696,462 | 12/1928 | Victor | 273/81 A |
| 1,982,087 | 11/1934 | Wantz | 273/80.2 X |
| 2,051,083 | 8/1936 | Hart | 273/81 A |
| 2,066,962 | 1/1937 | Cross | 273/80 A |
| 2,782,035 | 2/1957 | East | 273/81 A |
| 3,606,327 | 9/1971 | Gorman | 273/81 A |
| 3,608,907 | 9/1971 | Bouchard | 273/171 X |
| 3,841,639 | 10/1974 | Werner | 273/81 A X |
| 3,863,932 | 2/1975 | Lezatte | 273/169 |
| 3,873,094 | 3/1975 | Sebo et al. | 273/169 X |
| 4,058,312 | 11/1977 | Stuff et al. | 273/81 A X |
| 4,123,055 | 10/1978 | Brill | 273/80 B X |
| 4,165,874 | 8/1979 | Lezatte et al. | 273/80 B X |
| 4,280,700 | 7/1981 | Plagenhoef | 273/81 A X |
| 4,461,479 | 7/1984 | Mitchell | 273/81 A |

FOREIGN PATENT DOCUMENTS

| | | | |
|---|---|---|---|
| 17636 | of 1929 | Australia | 273/81 A |

*Primary Examiner*—William H. Grieb

*Attorney, Agent, or Firm*—Traynham, Parnass, & Czeciuk

[57] ABSTRACT

An improved golf club providing means for positioning the center of percussion in the head of each golf club so as to optimize the energy transfer between the club head and the golf ball and so as to optimize the feel of the golf shot for the golfer.

12 Claims, 14 Drawing Figures

GOLF CLUB

The present invention relates to an improved golf club allowing weight distribution to be customized for each golf club so as to improve the performance and feel of the golf club; more particularly, means are provided for moving the center of percussion into the head of the golf club.

THE PRIOR ART

Golf club designs incorporating various weight distribution techniques are well known. One typical prior art weight distribution scheme allows for making the head of the club lighter while adding compensating weight to the opposite end of the club in order to provide for a club having an overall weight which is approximately the same as before the weight distribution was changed. This sort of weight distribution technique is based primarily on the assumption that a lighter club head allows the golfer to swing the club with greater velocity and thereby increase the distance the ball will travel. Examples of this prior art are contained in U.S. Pat. Nos. 3,606,327 to Gorman, 4,165,874 to Lezatte et al., and the references cited therein. Other prior art weight distribution techniques shift weight toward the head of the club in order to place the center of gravity closer to the club head or to vary the "heft" of the club immediately adjacent the head. Examples of this prior art are found in U.S. Pat. Nos. 2,066,962 to Cross, 3,608,907 to Bouchard, and the references cited therein. Further weight distribution techniques employ adjustable weights attached to the shaft or grip of the club so as to give the club the desired balance or "feel", and are exemplified in U.S. Pat. Nos. 1,982,087 to Wantz, 2,782,035 to East, 2,051,083 to Hart, 1,676,270 to Mattison, 1,585,190 to Girdwood, 4,123,055 to Brill, and the references cited therein.

The primary problem with prior art weight distribution techniques of the type described above is that the weight is generally added to the wrong portions of the golf club and the reasons for locating various weights in specific locations are faulty. Stuff discloses that the addition of weight closer to the butt end of a golf club will maximize the effect of moving the center of percussion toward the head of the club; however, the structure disclosed by Stuff does not allow the addition of sufficient weight to move the center of percussion all the way down into the clubhead. Other prior art patents disclosing the addition of weight to the grip end of the club do not disclose structures which would enable one to move the center of percussion into the clubhead.

OBJECTS OF THE INVENTION

Accordingly, a primary object of the present invention is to provide a golf club design which substantially reduces the problems noted above.

A more specific object is to provide a golf club which has a weight distribution designed to place the center of percussion of the golf club in the club head.

A further object is to provide means for positioning the center of percussion within the head of various flailing implements such as baseball bats, hammers, axes, tennis rackets, racquetball rackets, and weed cutters.

SUMMARY OF THE PRESENT INVENTION

The foregoing objects, and other objects which will become apparent as the nature of the invention is better understood, are achieved by providing a golf club which comprises a club, a shaft, and a grip, all of known weight. Additional weight in the form of a counterweight is added to the shaft above the pivot point of the golf club in order to increase the pendulum length of the golf club and thereby position the center of percussion in the head of the golf club. Counterweights can also be added to flailing implements other than golf clubs (e.g., a hammer) in order to improve their performance and feel.

GENERAL DESCRIPTION OF THE DRAWINGS

For a fuller understanding of the nature and objects of the present invention, reference should be had to the following description taken in connection with the accompanying drawings wherein.

DETAILED DESCRIPTION OF THE DRAWINGS

Figure 1:
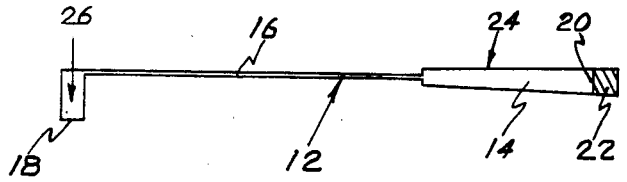
FIG. 1 illustrates a golf club of the present invention which has various component weights indicated by downward arrows.

The preferred embodiment of the present invention is shown in FIG. 1 and comprises a golf club 12 having a grip 14, a shaft 16, and a clubhead 18. Golf club 12 has a butt end 20 which is the end opposite clubhead 18. Club 12 also has an external counterweight 22 at the butt end 20. The counterweight 22 is located above pivot point 24 of club 12 so as to increase the pendulum length of the club sufficiently to position the center of percussion 26 in the clubhead 18. Pivot point 24 is that point about which the club 12 rotates, or pivots, as the club is swung by the golfer (not shown). The pivot point 24 may vary from one golfer to the next and is dependent upon the hand positions of the golfer. For purposes of illustration, pivot point 24 has been arbitrarily positioned five inches from the butt end 20 of the club 12 in this patent application. As a practical matter, most golfers have a pivot point which closely approximates this position (about five inches from butt end 20).

The method for getting the center of percussion 26 into the clubhead 18 is as follows. As additional counterweight 22 is added to the butt end 20, the pendulum length of the club 12 increases. The amount of counterweight 22 is adjusted so that the pendulum length is made to be equal to the distance between pivot point 24 and the center of clubhead 18; when this quantity of counterweight 22 has been added, the center of percussion 26 is located in the center of clubhead 18 as illustrated in FIG. 1. A more specific example follows:

EXAMPLE

For purposes of illustration, a driver will be chosen as the golf club in this example. Assume the length of the driver is 43 inches, and the weight of the shaft is 4.2 ounces. If the grip weighs 2 ounces and the clubhead weighs 7 ounces, the pendulum length can be increased to 38 inches by adding 3.6 ounces of lead counterweight 22 external to the butt end 20 of club 12. This puts the center of percussion of the driver in the clubhead 18, since the pivot point 24 is five (5) inches from butt end 20. The pendulum length of 38 inches added to the pivot point position (5) inches from the butt end) places the pendulum length 43 inches from butt end 20, or precisely within the volume of clubhead 18.

Figure 2:
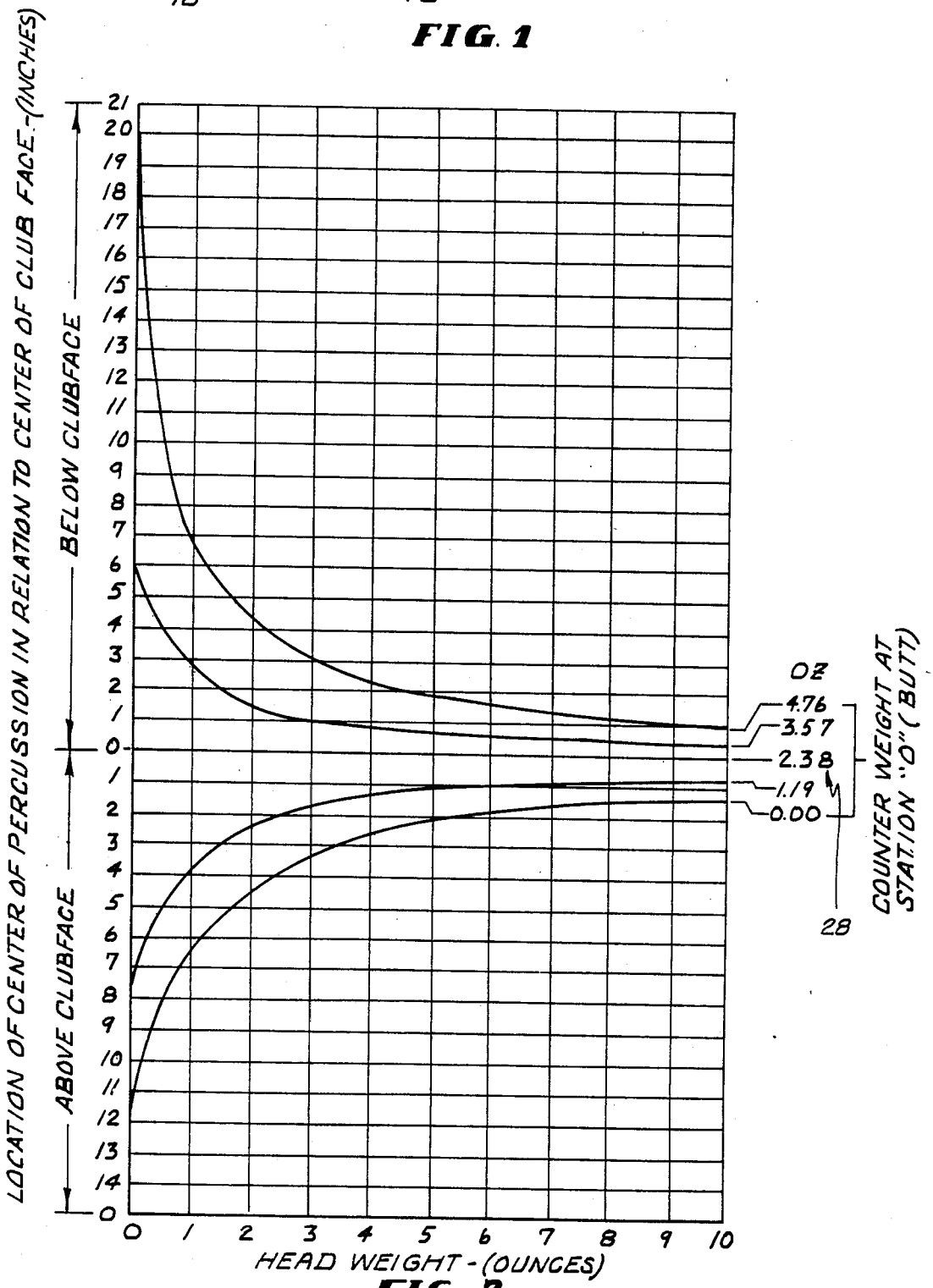
FIG. 2 depicts a family of curves generated by plotting the counterweight added (in ounces) versus the location of the center of percussion of the golf club.

FIG. 2 is a family of curves prepared for a driver 43 inches long with a shaft weighing 2.58 ounces and a grip weighing 2.0 ounces. As illustrated in FIG. 2, when just the right amount of counterweight 22 has been added to the golf club 12, the weight of the clubhead 18 can be altered in any manner without moving the center of percussion 26 out of the clubhead 18. More specifically, when the amount of counterweight indicated by numeral 28 in FIG. 2 is added to club 12, the weight of clubhead 18 can be increased or decreased without moving the center of percussion 26 from its original position in the center of the clubface. Indeed, it can be shown through calculations and graphs similar to FIG. 2 that for any golf club having a grip, a shaft and a clubhead of known weights, there exists a unique counterweight 22 which will move the center of percussion into the center of the clubhead. Once that unique counterweight 22 has been added to the golf club, weight can be added or subtracted from the center of the clubhead without moving the center of percussion.

Figure 3:
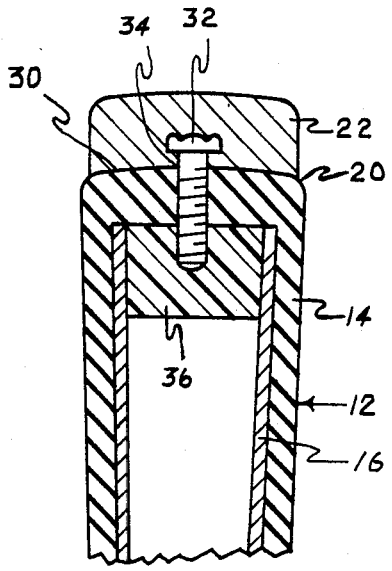
FIG. 3 is an enlarged fragmentary sectional view in elevation of the butt end of a golf club of the preferred embodiment showing an external counterweight attached to the club.

As shown in FIG. 3, counterweight 22 is affixed to golf club 12 by an adhesive 30, such as a contact cement or an epoxy adhesive. A fastener 32, such as a screw or bolt, is centrally embedded in counterweight 22 and extends from the lower surface of counterweight 22 so as to make a snug fit with an aperture 34 which is positioned at the top center of grip 14. In addition, fastener 32 engages a solid material 36, such as epoxy resin or polyester resin, which has been affixed to the interior of shaft 16. Fastener 32 is preferably a screw or a bolt in order to facilitate the removal and reinstallation of counterweight 22 relative to butt end 20 of club 12. External counterweight 22 is made of a relatively dense metal, such as tungsten, lead, brass, or steel, or a metal matrix composite or other suitably dense material. The shaft 16 can be made of metal, wood, or some other suitable composite material such as graphite, fiberglass, or other fibrous composites.

The primary advantage accruing from having the center of percussion 26 located in the head 18 is that energy transfer between the golf club 12 and a golf ball (not shown) is increased. The primary reason for this increased energy transfer efficiency is the minimization of energy lost due to resultant torque moments between the club 12 and the golf ball. If the center of percussion 26 is located in the head 18 exactly at the point of impact between the head 18 and the ball, then there should be absolutely no such resultant torque moments. Minor deviations between the point of impact and the position of the center of percussion 26 will result in small torque moments; however, the magnitude of the energy loss due to these small moments is negligible relative to standard clubs having their centers of percussion located well above the clubhead 18.

Another advantage of having the center of percussion 26 located in clubhead 18 is that the golfer feels a much more solid hit when the clubhead 18 strikes the golf ball. This solid hit feeling can give a golfer an important psychological advantage.

Figure 4:
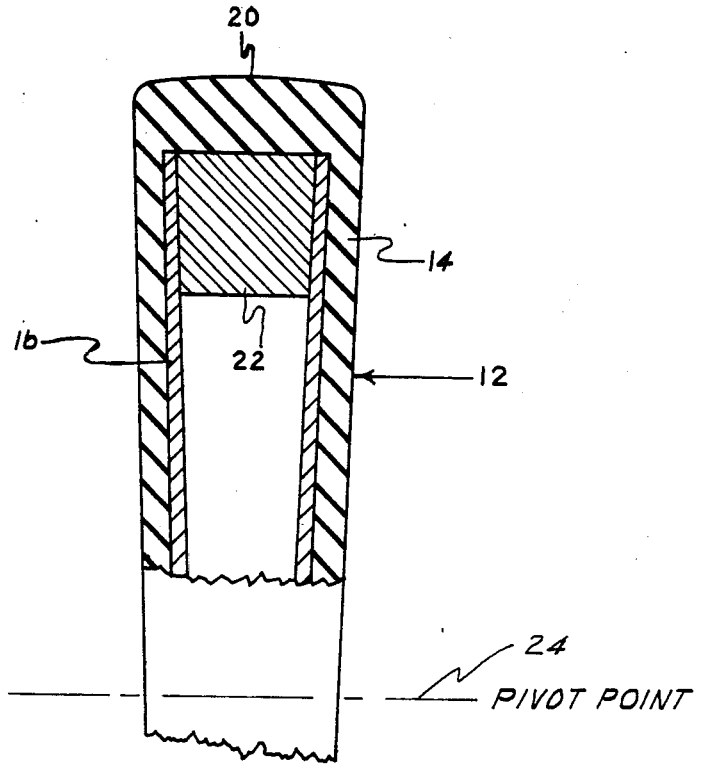
FIG. 4 is an enlarged fragmentary sectional view in elevation of the butt end of a modified golf club showing an internal counterweight added to the club as close to the butt end as possible.
Figure 5:
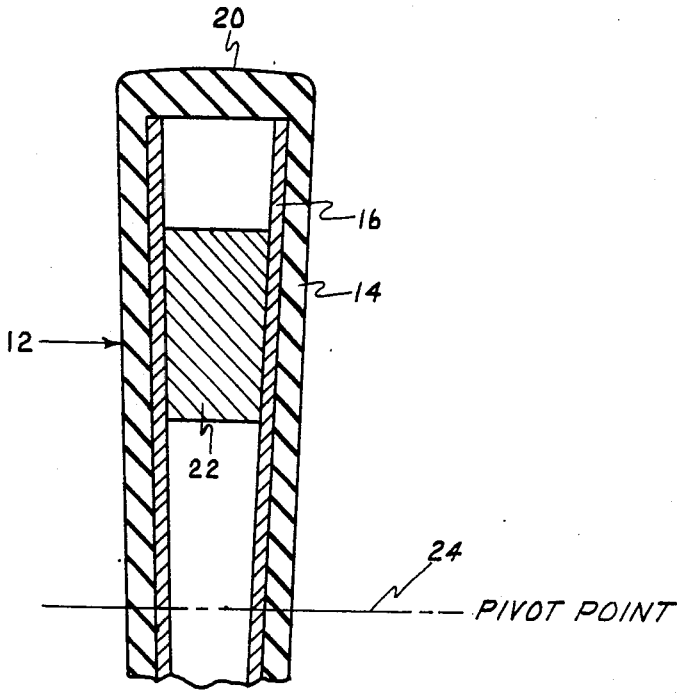
FIG. 5 is an enlarged fragmentary sectional view in elevation of the butt end of another modification of the internal counterweight configuration of a golf club, with the counterweight added to a position intermediate of the butt end of the golf club and the pivot point of the golf club.
Figure 6:
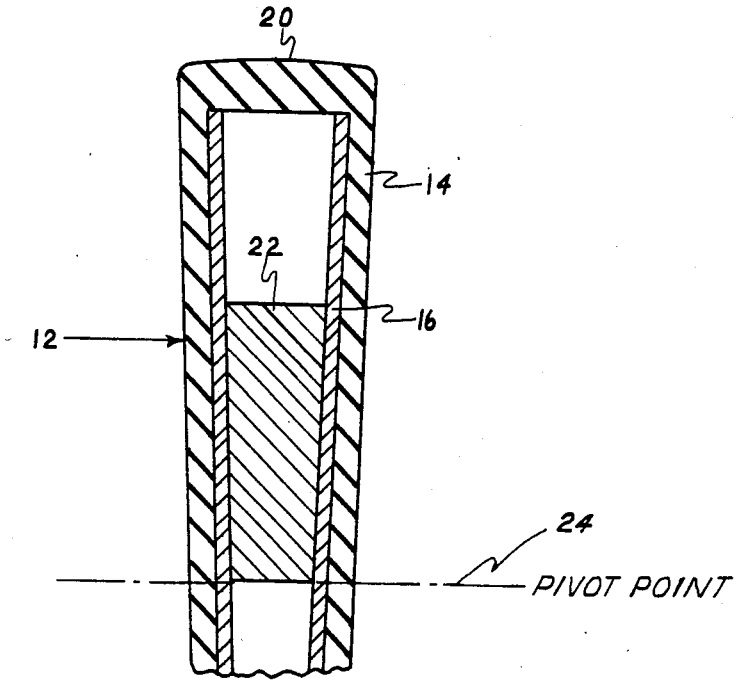
FIG. 6 is an enlarged fragmentary sectional view in elevation of a further modification of a golf club having an internal counterweight, with the counterweight located above the pivot point (near the butt end) and as close to the pivot point as possible.

A number of variations of the invention described above are possible. The counterweight 22 can be added to the butt end 20 of the club 12 by adding the necessary weight to the grip 26 before attaching the grip to the club 12. Another possible modification comprises the addition of counterweight 22 to butt end 20 of club 12 by inserting counterweight 22 into the interior of shaft 16, as shown in FIGS. 4, 5, and 6. The relative volumes for counterweight 22 in FIGS. 4–6 are approximate for a counterweight 22 made of tungsten. FIG. 4 illustrates the method for minimizing the quantity of counterweight 22 required to move the center of percussion 26 into clubhead 18. FIG. 5 depicts an alternate technique which requires more counterweight 22 than the modification shown in FIG. 4. FIG. 6 shows a third possible method of adding counterweight 22 to the interior of shaft 16 —the counterweight 22 is added as close to pivot point 24 as possible, and more counterweight 22 is required for this configuration than is required for the configurations shown in either FIG. 4 or FIG. 5.

Figure 7:
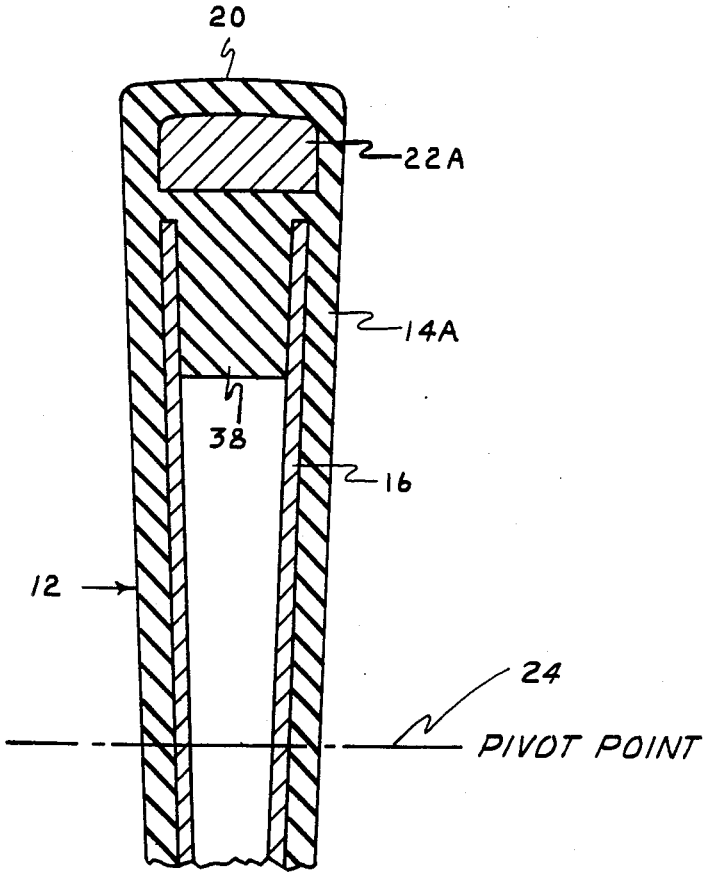
FIG. 7 is an enlarged fragmentary sectional view in elevation of another modification of a golf club having a counterweight integrally formed with the grip.

FIG. 7 illustrates a counterweight 22A which has been integrally affixed to a modified grip 14A, for example by using existing molding techniques, near butt end 20 of the golf club 12. A plug 38, made of the material from which the grip 14A is made, protrudes down into the interior of shaft 16 so as to further stabilize the upper end of this modified grip 14A and thereby make the grip 14A more rigid.

Figure 8:
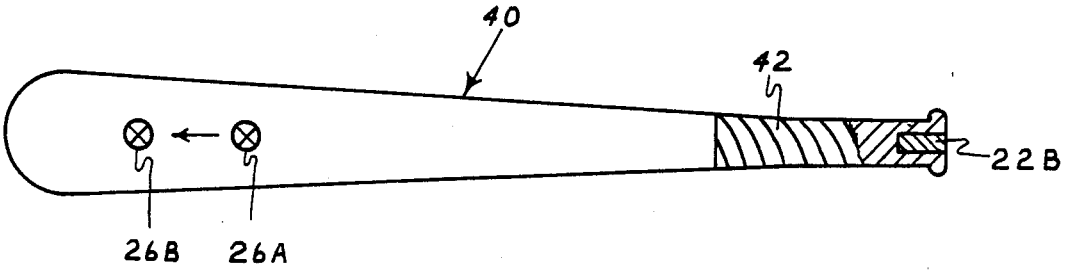
FIG. 8 shows a baseball bat with a counterweight added to the handle end of the bat.

FIG. 8 shows a baseball bat 40 which has a counterweight 22B added to handle 42 of the bat in order to move the center of percussion 26A of the bat to any desired position, for example new position 26B, along the length of bat 40.

Figure 9:
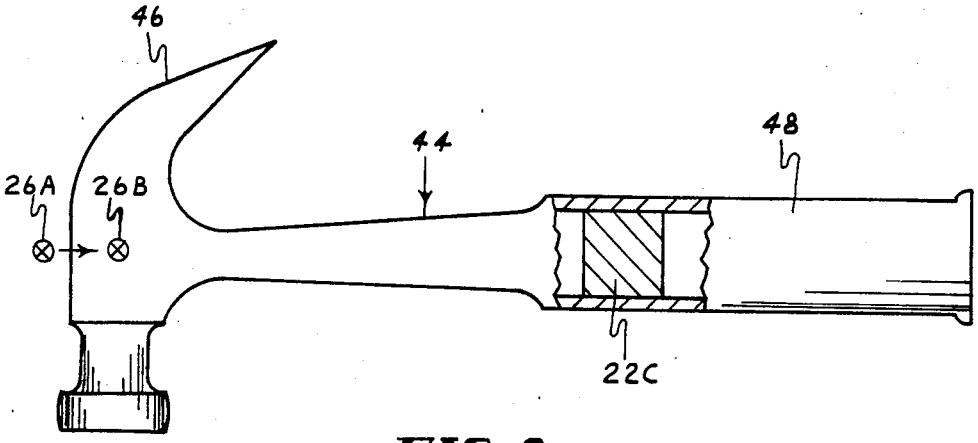
FIG. 9 illustrates a hammer with a counterweight added to its handle.

FIG. 9 depicts a hammer 44 made of metal and having a head 46 and a hollow handle 48 which is sized so as to accommodate a counterweight 22C positioned within the interior of handle 48. The weight of counterweight 22C is preselected so as to ensure that the center of percussion 26A of hammer 44 moves into the volume of head 46 to position 26B.

Figure 10:
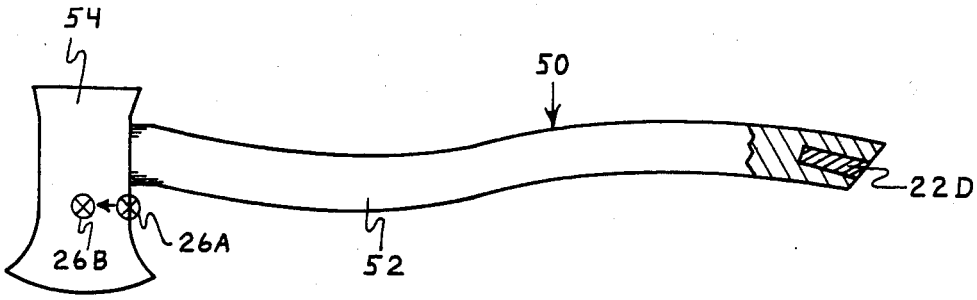
FIG. 10 depicts an axe having a counterweight added to its handle.

FIG. 10 shows an axe 50 having a counterweight 22D positioned inside a handle 52 at the end of axe 50 opposite axe head 54 in order to move the center of percussion 26A into the center of head 54 at 26B.

Figure 11:
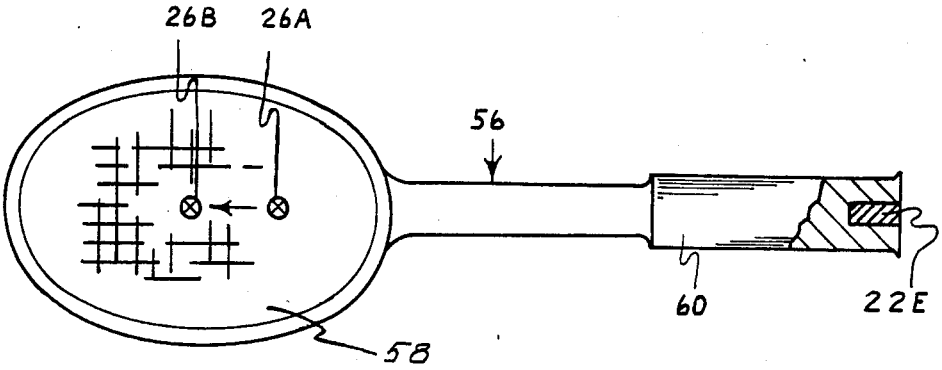
FIG. 11 is a front view in elevation of a tennis racket having a counterweight added to its handle.

FIG. 11 illustrates a tennis racket 56 with a racket head 58 and a handle 60 and a counterweight 22E located within handle 60. Counterweight 22E is weighted so as to allow the center of percussion 26A to be located at any desired location 26B within the area of the racket head 58.

Figure 12:
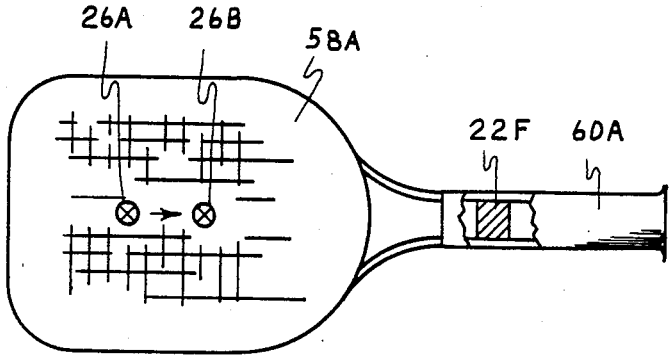
FIG. 12 is a front view in elevation of a racquetball racket with a counterweight added to its handle.

FIG. 12 is a view of a racquetball racket 56A which is similar to tennis racket 56. Racket 56A also has a racket head 58A and a handle 60A, with a counterweight 22F inserted within handle 60A in order to allow for the precise placement of the center of percussion 26A to any desired spot 26B within the area of racket head 58A.

Figure 13A:
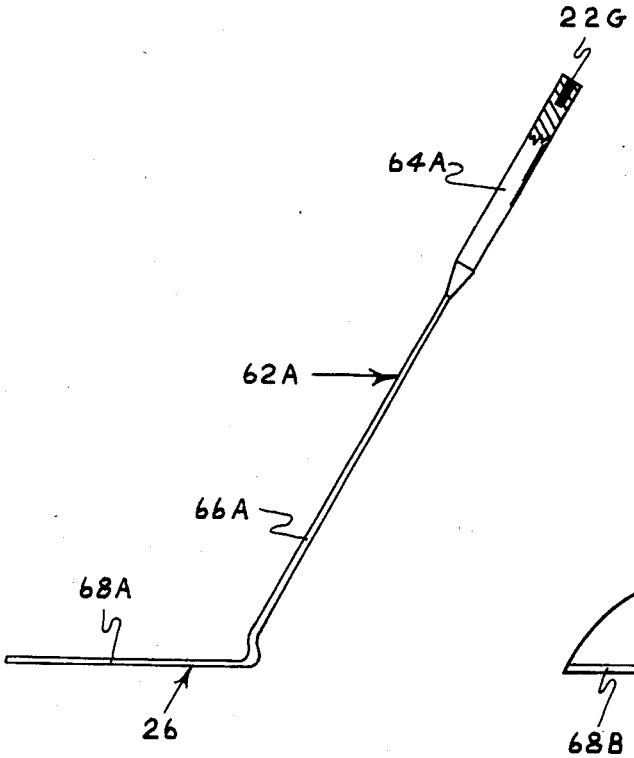
FIG. 13A is a drawing of a weed cutter having a counterweight added to its handle.
Figure 13B:
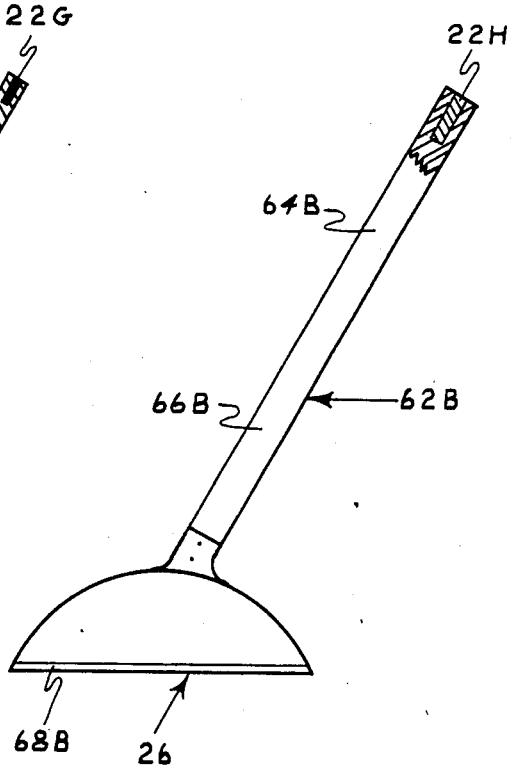
FIG. 13B is a drawing of another configuration of a weed cutter which also has a counterweight added to its handle.

Finally, FIGS. 13A and 13B depict two configurations of weed cutters 62A and 62B having handles 64A and 64B, shafts 66A and 66B, and cutter heads 68A and 68B, respectively. Weed cutter 62A has a counterweight 22G located in its handle 64A, and weed cutter 62B similarly has a counterweight 22H positioned within its handle 64B in order to place the centers of percussion 26 within the volume of the cutter heads 68A and 68B.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. An improved golf club comprising in combination:

a shaft having a first end and a second end;

a grip nonmovably affixed to said first end of said shaft;

a clubhead nonmovably attached to said second end of said shaft;

a pivot point intermediate said first and second ends of said shaft, said pivot point being the point about which said golf club rotates when swung by a golfer and said pivot point normally being located closer to said first end than said second end; and means for positioning the center of percussion of said golf club anywhere within the volume of said clubhead, said means comprising a counterweight added to the interior of said shaft between said pivot point and said first end of said shaft, said counterweight having a unique predetermined value independent of weight added to or subtracted from said club at the location of said center of percussion.

2. An improved golf club according to claim 1 wherein said counterweight is made of tungsten.

3. An improved golf club according to claim 1 wherein said counterweight is made of brass.

4. An improved golf club according to claim 1 wherein said counterweight is made of lead.

5. An improved golf club according to claim 1 wherein said counterweight is made of steel.

6. An improved golf club according to claim 1 wherein said counterweight is made of a metal matrix composite.

7. An improved golf club comprising in combination:

a shaft having a first end and a second end;

a grip nonmovably affixed to said first end of said shaft;

a clubhead nonmovably attached to said second end of said shaft;

a pivot point intermediate said first and second ends of said shaft, said pivot point being the point about which said golf club rotates when swung by a golfer and said pivot point normally being located closer to said first end than said second end; and means for positioning the center of percussion of said golf club anywhere within the volume of said clubhead, said means for positioning the center of percussion of said golf club in said clubhead comprising a counterweight concentric with and juxtaposed to said grip, said counterweight having a unique predetermined value independent of weight added to or substracted from said club at the location of said center of percussion.

8. An improved golf club according to claim 7 wherein said counterweight is made of tungsten.

9. An improved golf club according to claim 7 wherein said counterweight is made of brass.

10. An improved golf club according to claim 7 wherein said counterweight is made of lead.

11. An improved golf club according to claim 7 wherein said counterweight is made of steel.

12. An improved golf club according to claim 7 wherein said counterweight is made of a metal matrix composite.

* * * * *